US008381756B2

(12) United States Patent
Sakane et al.

(10) Patent No.: US 8,381,756 B2
(45) Date of Patent: Feb. 26, 2013

(54) METHOD FOR SUPPLYING GAS

(75) Inventors: Makoto Sakane, Tokyo (JP); Takashi Yoneda, Tokyo (JP); Yoshinori Ito, Tokyo (JP)

(73) Assignee: Taiyo Nippon Sanso Corporation, Tokyo (JP)

( * ) Notice: Subject to any disclaimer, the term of this patent is extended or adjusted under 35 U.S.C. 154(b) by 4 days.

(21) Appl. No.: 12/998,804

(22) PCT Filed: Dec. 2, 2009

(86) PCT No.: PCT/JP2009/070232

§ 371 (c)(1),
(2), (4) Date: Jun. 3, 2011

(87) PCT Pub. No.: WO2010/064651

PCT Pub. Date: Jun. 10, 2010

(65) Prior Publication Data

US 2011/0232772 A1 Sep. 29, 2011

(30) Foreign Application Priority Data

Dec. 3, 2008 (JP) ..... 2008-308245

(51) Int. Cl.
*F17C 11/00* (2006.01)
*F17C 5/00* (2006.01)

(52) U.S. Cl. ..... 137/112; 137/113; 137/267; 137/256; 137/12

(58) Field of Classification Search ..... 137/87.03, 137/12, 111–114, 209, 256, 266, 267
See application file for complete search history.

(56) References Cited

U.S. PATENT DOCUMENTS
(Continued)

FOREIGN PATENT DOCUMENTS

JP 2501913 B2 4/1991
JP 2007-051682 A 3/2007
(Continued)

OTHER PUBLICATIONS

International Search Report dated Jan. 19, 2010, issue for PCT/JP2009/070232.

(Continued)

*Primary Examiner* — Craig Schneider
*Assistant Examiner* — Angelisa Hicks
(74) *Attorney, Agent, or Firm* — Edwards Wildman Palmer LLP

(57) ABSTRACT

[Problem] The present invention provides a gas supply method by which a gas in a gas container can be effectively utilized.
[Means for Solving the Problem] On the basis of: the maximum flow rate (a first preset flow rate (Q1)) and the minimum flow rate (a second preset flow rate (Q2)) at the place where the gas is used; a first preset pressure (P1) at which the gas can be supplied at a first preset flow rate (Q1); a second preset pressure (P2) at which the gas can be supplied at a second preset flow rate (Q2); a third preset pressure (P3) which is higher than the first preset pressure (P1); residual pressures (PA, PB) in gas containers (SA, SB); a supplied gas flow rate (Q); and the relationship between the residual pressures (PA, PB) and suppliable gas flow rates (QPA and QPB, respectively), the residual pressures (PA, PB) and the supplied gas flow rate (Q) are monitored and the gas supply is switched between the first gas container (SA) and the second gas container (SB).

12 Claims, 8 Drawing Sheets

U.S. PATENT DOCUMENTS

| | | | | |
|---|---|---|---|---|
| 3,643,677 | A * | 2/1972 | Begleiter | 137/113 |
| 3,807,422 | A * | 4/1974 | McJones | 137/12 |
| 6,779,568 | B2 * | 8/2004 | Borck | 141/67 |

FOREIGN PATENT DOCUMENTS

| | | | |
|---|---|---|---|
| JP | 2007-107713 | A | 4/2007 |

OTHER PUBLICATIONS

Office Action dated Sep. 27, 2012, issued for the corresponding Chinese patent application No. 200980148736.0 and English translation thereof.

* cited by examiner

METHOD FOR SUPPLYING GAS

TECHNICAL FIELD

The present invention relates to a gas supply method. Particularly, the present invention relates to a gas supply method by which a compressed gas loaded in gas containers, each of which is connected to one of plural of gas supply systems, is supplied to a place of use thereof where the gas usage flow rate fluctuates.

BACKGROUND ART

In a production step of semiconductors and chemical products, a variety of gasses are used and these gasses are supplied, for example, via a pipe from a gas container loaded with a high-pressure gas. In cases where the gas needs to be supplied continuously, plural gas containers are connected in parallel. When the residual pressure in one of the gas containers decreases to a preset lower limit, the gas supply is switched to another gas container and at the same time, the gas container in which the pressure decreased is replaced with a new gas container to be put on standby (for example, see Patent Document 1). Also, the amount of residual gas in each of the plural gas containers is detected to select a gas container having a low amount of the residual gas, which is used to supply the gas (for example, see Patent Document 2).

PRIOR ART DOCUMENTS

Patent Documents

Patent Document 1: JP 2501913 B
Patent Document 2: JP 2007-107713 A

SUMMARY OF THE INVENTION

Problems to be Solved by the Invention

When supplying a gas to a place of use thereof from a gas container loaded with a high-pressure compressed gas, the gas flow rate at which the gas can be supplied from the gas container to the place of use varies depending on the pressure of the gas used at the place of use, the pressure loss in the gas supply equipment and the type of the gas. In order to supply the gas at a stable flow rate, there must be a pressure difference corresponding to the gas flow rate between the gas container(s) of the gas supply equipment and the place of use. In addition, the preset gas flow rates at which the gas is supplied to the place of use is generally set based on the maximum gas flow rate at the place of use.

For example, in cases where the pressure difference required for supplying the gas at the maximum gas flow rate at the place of use is about 0.7 MPa (gauge pressure; this applies hereinafter), the lower limit of the residual pressure in the gas container is considered to be about 1 MPa. In both cases of the aforementioned Patent Documents 1 and 2, the container is replaced when the residual pressure becomes 1 MPa. In these cases, the gas having a pressure of 1 MPa still remains in the container at an amount of the container volume. Accordingly, in case where a large-sized gas container is employed, a large amount of gas would still remain therein in an unused condition.

In view of the above, an object of the present invention is to provide a gas supply method in which, since the pressure difference required for supplying a gas fluctuates with the changes in the gas usage flow rate at the place of use, when supplying a gas to a place of use thereof where the gas usage flow rate fluctuates, for example, by arranging plural gas supply systems in accordance with the fluctuations in the gas flow rates, an adjustment can be appropriately made in response to the fluctuations in the gas flow rates so as to be able to lower the residual pressure at the time of container replacement, thereby allowing the gas in the gas container to be utilized effectively.

Means for Solving the Problems

In order to achieve the above object, the first constitution of the gas supply method according to the present invention is, in a gas supply method by which a compressed gas loaded in gas containers, each of which is connected to one of plural of gas supply systems, is supplied to a place of use thereof where gas usage flow rate fluctuates, characterized in that, by monitoring residual pressures (PA, PB) in the aforementioned gas containers and a supplied gas flow rate (Q): during a period in which the residual pressures (PA, PB) of a first gas container (SA) and a second gas container (SB), respectively, are both not less than a first preset pressure (P1) and the gas is supplied to the place of use thereof from the first gas container (SA), when the residual pressure (PA) in the first gas container (SA) decreased to the first preset pressure (P1), supply of the gas to the place of use is switched from the first gas container (SA) to the second gas container (SB); during a period in which, after the switching, the gas is supplied to the place of use from the second gas container (SB), when the supplied gas flow rate (Q) became less than a gas flow rate (QPA) which can be supplied from the first gas container (SA) having the residual pressure (PA) in the range of less than the first preset pressure (P1) and not less than the second preset pressure (P2), supply of the gas to the place of use is switched from the second gas container (SB) to the first gas container (SA); during a period in which the gas is supplied to the place of use thereof from the first gas container (SA) whose the residual pressure (PA) is less than the first preset pressure (P1) and not less than the second preset pressure (P2), when the supplied gas flow rate (Q) became not less than the gas flow rate (QPA) suppliable from the first gas container (SA), supply of the gas to the place of use is switched from the first gas container (SA) to the second gas container (SB); during the period in which the gas is supplied to the place of use thereof from the first gas container (SA) whose the residual pressure (PA) is less than the first preset pressure (P1) and not less than the second preset pressure (P2), when the residual pressure (PA) in the first gas container (SA) decreased to the preset pressure (P2), supply of the gas to the place of use is switched from the first gas container (SA) to the second gas container (SB) and at the same time, the first gas container (SA) is replaced; and, during a period in which the residual pressure (PA) in the first gas container (SA) is less than the first preset pressure (P1) and the gas is supplied to the place of use thereof from the second gas container (SB) whose the residual pressure (PB) is not less than the first preset pressure (P1), when the residual pressure (PB) in the second gas container (SB) decreased to a third preset pressure (P3), the first gas container (SA) is replaced (wherein, the aforementioned first preset pressure (P1) is a pressure at which the residual pressure in the gas container capable of supplying the gas at a flow rate corresponding to the first preset flow rate (Q1) was set; the aforementioned second preset pressure (P2) is a pressure at which the residual pressure in the gas container capable of supplying the gas at a flow rate corresponding to the second preset flow rate (Q2) was set; the aforementioned third preset pressure (P3) is a pressure set higher than the aforementioned first pressure (P1) and lower than a gas loading pressure; the aforementioned residual pressures (PA, PB) are residual pressures obtained by detecting the pressures in the aforementioned gas containers (SA, SB); the aforementioned supplied gas flow rate (Q) is a gas flow rate obtained by detecting the flow rate of the gas being supplied to the place of use thereof; and the aforementioned gas flow rates (QPA, QPB) are gas flow rates suppliable at the aforementioned residual pressures (PA, PB) in the gas containers; with the proviso that: the aforementioned first preset flow rate (Q1) is a flow rate which was set in advance at the place of use of the gas; and the aforementioned second preset flow rate (Q2) is a flow rate which was set in advance at the place of use of the gas and is lower than the aforementioned first preset flow rate (Q1)).

The second constitution of the gas supply method according to the present invention is, in a gas supply method by which a compressed gas loaded in gas containers, each of which is connected to one of plural of gas supply systems, is supplied to a place of use thereof where gas usage flow rate fluctuates, characterized in that, by monitoring residual pressures (PA, PB) in the aforementioned gas containers: during a period in which the residual pressures (PA, PB) of a first gas container (SA) and a second gas container (SB), respectively, are both not less than a first preset pressure (P1) and the gas is supplied to the place of use thereof from the first gas container (SA), when the residual pressure (PA) in the first gas container (SA) decreased to the first preset pressure (P1), the gas starts to be supplied from the second gas container (SB), so that the gas is supplied to the place of use thereof from both of the first and second gas containers (SA, SB); and during a period in which the gas is supplied to the place of use thereof from the first and second gas containers (SA, SB), when the residual pressure (PA) in the first gas container (SA) having a lower residual pressure decreased to a second preset pressure (P2) or when the residual pressure (PB) in the second gas container (SB) having a higher residual pressure decreased to a third preset pressure (P3), the first gas container (SA) is replaced (wherein, the aforementioned first preset pressure (P1) is a pressure at which the residual pressure in the gas container capable of supplying the gas at a flow rate corresponding to the first preset flow rate (Q1) was set; the aforementioned second preset pressure (P2) is a pressure at which the residual pressure in the gas container capable of supplying the gas at a flow rate corresponding to the second preset flow rate (Q2) was set; the aforementioned third preset pressure (P3) is a pressure set higher than the aforementioned first pressure (P1) and lower than a gas loading pressure; and the aforementioned residual pressures (PA, PB) are residual pressures obtained by detecting the pressures in the aforementioned gas containers (SA, SB); with the proviso that: the aforementioned first preset flow rate (Q1) is a flow rate which was set in advance at the place of use of the gas; and the aforementioned second preset flow rate (Q2) is a flow rate which was set in advance at the place of use of the gas and is lower than the aforementioned first preset flow rate (Q1)).

The third constitution of the gas supply method according to the present invention is, in a gas supply method by which a compressed gas loaded in gas containers, each of which is connected to one of plural of gas supply systems, is supplied to a place of use thereof where gas usage flow rate fluctuates, characterized in that, by monitoring residual pressures (PA, PB) in the aforementioned gas containers and a supplied gas flow rate (Q): during a period in which the residual pressures (PA, PB) of a first gas container (SA) and a second gas container (SB), respectively, are both not less than a first preset pressure (P1) and the gas is supplied to the place of use thereof from the first gas container (SA), when the residual pressure (PA) in the first gas container (SA) decreased to the first preset pressure (P1), the gas starts to be supplied from the second gas container (SB), so that the gas is supplied to the place of use thereof from both of the first and second gas containers (SA, SB); during a period in which the gas is supplied to the place of use thereof from the first and second gas containers (SA, SB), when the supplied gas flow rate (Q) became less than a gas flow rate (QPA) which can be supplied from the first gas container (SA) having the residual pressure (PA) in the range of less than the first preset pressure (P1) and not less than the second preset pressure (P2), supply of the gas from the second gas container (SB) is stopped and the gas is supplied to the place of use thereof from the first gas container (SA); and during a period in which the gas is supplied to the place of use thereof from the first gas container (SA) whose the residual pressure (PA) is less than the first preset pressure (P1) and not less than the second preset pressure (P2), when the supplied gas flow rate (Q) became not less than the gas flow rate (QPA) suppliable from the first gas container (SA), the gas starts to be supplied from the second gas container (SB), so that the gas is supplied to the place of use thereof from both of the first and second gas containers (SA, SB), and when the residual pressure (PA) in the first gas container (SA) having a lower residual pressure decreased to the second preset pressure (P2) or when the residual pressure (PB) in the second gas container (SB) having a higher residual pressure decreased to a third preset pressure (P3), the first gas container (SA) is replaced (wherein, the aforementioned first preset pressure (P1) is a pressure at which the residual pressure in the gas container capable of supplying the gas at a flow rate corresponding to the first preset flow rate (Q1) was set; the aforementioned second preset pressure (P2) is a pressure at which the residual pressure in the gas container capable of supplying the gas at a flow rate corresponding to the second preset flow rate (Q2) was set; the aforementioned third preset pressure (P3) is a pressure set higher than the aforementioned first pressure (P1) and lower than a gas loading pressure; the aforementioned residual pressures (PA, PB) are residual pressures obtained by detecting the pressures in the aforementioned gas containers (SA, SB); the aforementioned supplied gas flow rate (Q) is a gas flow rate obtained by detecting the flow rate of the gas being supplied to the place of use thereof; and the aforementioned gas flow rates (QPA, QPB) are gas flow rates suppliable at the aforementioned residual pressures (PA, PB) in the gas containers; with the proviso that: the aforementioned first preset flow rate (Q1) is a flow rate which was set in advance at the place of use of the gas; and the aforementioned second preset flow rate (Q2) is a flow rate which was set in advance at the place of use of the gas and is lower than the aforementioned first preset flow rate (Q1)).

The fourth constitution of the gas supply method according to the present invention is, in a gas supply method by which a compressed gas loaded in gas containers, each of which is connected to one of plural of gas supply systems, is supplied to a place of use thereof where gas usage flow rate fluctuates, characterized in that, by monitoring residual pressures (PA, PB) in the aforementioned gas containers and a supplied gas flow rate (Q): during a period in which the residual pressures (PA, PB) of a first gas container (SA) and a second gas container (SB), respectively, are both not less than a first preset pressure (P1) and the gas is supplied to the place of use thereof from the first gas container (SA), when the residual pressure (PA) in the first gas container (SA) decreased to the first preset pressure (P1), the gas starts to be supplied from the second gas container (SB), so that the gas is supplied to the place of use thereof from both of the first and second gas containers (SA, SB); and during a period in which the gas is supplied to the place of use thereof from the first and second gas containers (SA, SB), when supply of the gas from the second gas container (SB) having a higher residual pressure was suspended and the supplied gas flow rate (Q) does not fluctuate, the gas is supplied to the place of use thereof from the first gas container (SA) while suspending the supply of the gas from the second gas container (SB), and when the supply of the gas from the second gas container (SB) having a higher residual pressure was suspended and the supplied gas flow rate (Q) fluctuated, the supply of the gas from the second gas container (SB) is resumed, so that the gas is supplied to the place of use thereof from both of the first and second gas containers (SA, SB), and further, when the residual pressure (PA) in the first gas container (SA) having a lower residual pressure decreased to a second preset pressure (P2) or when the residual pressure (PB) in the second gas container (SB) having a higher residual pressure decreased to a third preset pressure (P3), the first gas container (SA) is replaced (wherein, the aforementioned first preset pressure (P1) is a pressure at which the residual pressure in the gas container capable of supplying the gas at a flow rate corresponding to the first preset flow rate (Q1) was set; the aforementioned second preset pressure (P2) is a pressure at which the residual pressure in the gas container capable of supplying the gas at a flow rate corresponding to the second preset flow rate (Q2) was set; the aforementioned third preset pressure (P3) is a pressure set higher than the aforementioned first pressure (P1) and lower than a gas loading pressure; the aforementioned residual pressures (PA, PB) are residual pressures obtained by detecting the pressures in the aforementioned gas containers (SA, SB); the aforementioned supplied gas flow rate (Q) is a gas flow rate obtained by detecting the flow rate of the gas being supplied to the place of use thereof; and the aforementioned gas flow rates (QPA, QPB) are gas flow rates suppliable at the aforementioned residual pressures (PA, PB) in the gas containers; with the proviso that: the aforementioned first preset flow rate (Q1) is a flow rate which was set in advance at the place of use of the gas; and the aforementioned second preset flow rate (Q2) is a flow rate which was set in advance at the place of use of the gas and is lower than the aforementioned first preset flow rate (Q1)).

The fifth constitution of the gas supply method according to the present invention is, in a gas supply method by which a compressed gas loaded in gas containers, each of which is connected to one of plural of gas supply systems, is supplied to a place of use thereof where gas usage flow rate fluctuates, characterized in that, by monitoring residual pressures (PA, PB) in the aforementioned gas containers and a supplied gas flow rate (Q), in cases where the residual pressure (PA) in a first gas container (SA) is lower than the residual pressure (PB) in the other second gas container (SB): when the supplied gas flow rate (Q) is less than a gas flow rate (QPA) suppliable from the first gas container (SA) having a lower residual pressure, the gas is supplied to the place of use thereof from the first gas container (SA) having a lower residual pressure; when the supplied gas flow rate (Q) is not less than the gas flow rate (QPA) suppliable from the first gas container (SA) having a lower residual pressure, supply of the gas to the place of use is switched from the first gas container (SA) to the second gas container (SB) having a higher residual pressure or the gas starts to be supplied from the second gas container (SB), so that the gas is supplied to the place of use thereof from both of the first and second gas containers (SA, SB); when the residual pressure (PA) in the first gas container (SA) having a lower residual pressure decreased to a second preset pressure (P2) or when the residual pressure (PB) in the second gas container (SB) having a higher residual pressure decreased to a third preset pressure (P3), the first gas container (SA) is replaced (wherein, the aforementioned first preset pressure (P1) is a pressure at which the residual pressure in the gas container capable of supplying the gas at a flow rate corresponding to the first preset flow rate (Q1) was set; the aforementioned second preset pressure (P2) is a pressure at which the residual pressure in the gas container capable of supplying the gas at a flow rate corresponding to the second preset flow rate (Q2) was set; the aforementioned third preset pressure (P3) is a pressure set higher than the aforementioned first pressure (P1) and lower than a gas loading pressure; the aforementioned residual pressures (PA, PB) are residual pressures obtained by detecting the pressures in the aforementioned gas containers (SA, SB); the aforementioned supplied gas flow rate (Q) is a gas flow rate obtained by detecting the flow rate of the gas being supplied to the place of use thereof; and the aforementioned gas flow rates (QPA, QPB) are gas flow rates suppliable at the aforementioned residual pressures (PA, PB) in the gas containers; with the proviso that: the aforementioned first preset flow rate (Q1) is a flow rate which was set in advance at the place of use of the gas; and the aforementioned second preset flow rate (Q2) is a flow rate which was set in advance at the place of use of the gas and is lower than the aforementioned first preset flow rate (Q1)).

The sixth constitution of the gas supply method according to the present invention is, in a gas supply method by which a compressed gas loaded in gas containers, each of which is connected to one of plural of gas supply systems, is supplied to a place of use thereof where gas usage flow rate fluctuates, characterized in that, by monitoring residual pressures (PA, PB) in the aforementioned gas containers and a detected supply pressure (PT): during a period in which the residual pressures (PA, PB) of a first gas container (SA) and a second gas container (SB), respectively, are both not less than a first preset pressure (P1) and the gas is supplied to the place of use thereof from the first gas container (SA), when the residual pressure (PA) in the first gas container (SA) decreased to the first preset pressure (P1), the gas starts to be supplied from the second gas container (SB), so that the gas is supplied to the place of use thereof from both of the first and second gas containers (SA, SB); and during a period in which the gas is supplied to the place of use thereof from the first and second gas containers (SA, SB), when supply of the gas from the second gas container (SB) having a higher residual pressure was suspended and the detected supply pressure (PT) does not decrease, the gas is supplied to the place of use thereof from the first gas container (SA) while suspending the supply of the gas from the second gas container (SB), and when the supply of the gas from the second gas container (SB) having a higher residual pressure was suspended and the detected supply pressure (PT) decreased, the supply of the gas from the second gas container (SB) is resumed, so that the gas is supplied to the place of use thereof from both of the first and second gas containers (SA, SB), and further, when the residual pressure (PA) in the first gas container (SA) having a lower residual pressure decreased to a second preset pressure (P2) or when the residual pressure (PB) in the second gas container (SB) having a higher residual pressure decreased to a third preset pressure (P3), the first gas container (SA) is replaced (wherein, the aforementioned preset supply pressure (PS) is a pressure set in advance at the place of use of the gas; the aforementioned first preset pressure (P1) is a pressure at which the residual pressure in the gas container capable of supplying the gas at a flow rate corresponding to the first preset flow rate (Q1) was set; the aforementioned second preset pressure (P2) is a pressure at which the residual pressure in the gas container capable of supplying the gas at a flow rate corresponding to the second preset flow rate (Q2) was set; the aforementioned third preset pressure (P3) is a pressure set higher than the aforementioned first pressure (P1) and lower than a gas loading pressure; the aforementioned residual pressures (PA, PB) are residual pressures obtained by detecting the pressures in the aforementioned gas containers (SA, SB); and the aforementioned detected supply pressure (PT) is a pressure obtained by detecting the pressure being supplied to the place of use thereof; with the proviso that: the aforementioned first preset flow rate (Q1) is a flow rate which was set in advance at the place of use of the gas; and the aforementioned second preset flow rate (Q2) is a flow rate which was set in advance at the place of use of the gas and is lower than the aforementioned first preset flow rate (Q1)).

Further, the gas supply method according to the present invention is, in the above-described constitutions, characterized in that the relationship between the residual pressures in the gas containers and the suppliable gas flow rates have been set in advance in accordance with the type of the gas to be supplied and the constitution of the gas supply systems.

Effects of the Invention

According to the gas supply method of the present invention, for example, by arranging plural gas supply systems in accordance with the fluctuations in the usage flow rate and the supply pressures, an adjustment can be appropriately made in response to the fluctuations in the aforementioned flow rates and pressures. Consequently, when the gas can be supplied even at a low residual pressure, the gas is supplied from a gas container having a low residual pressure, so that the compressed gas loaded in the gas container can be effectively utilized.

BEST MODE FOR CARRYING OUT THE INVENTION

Figure 1:
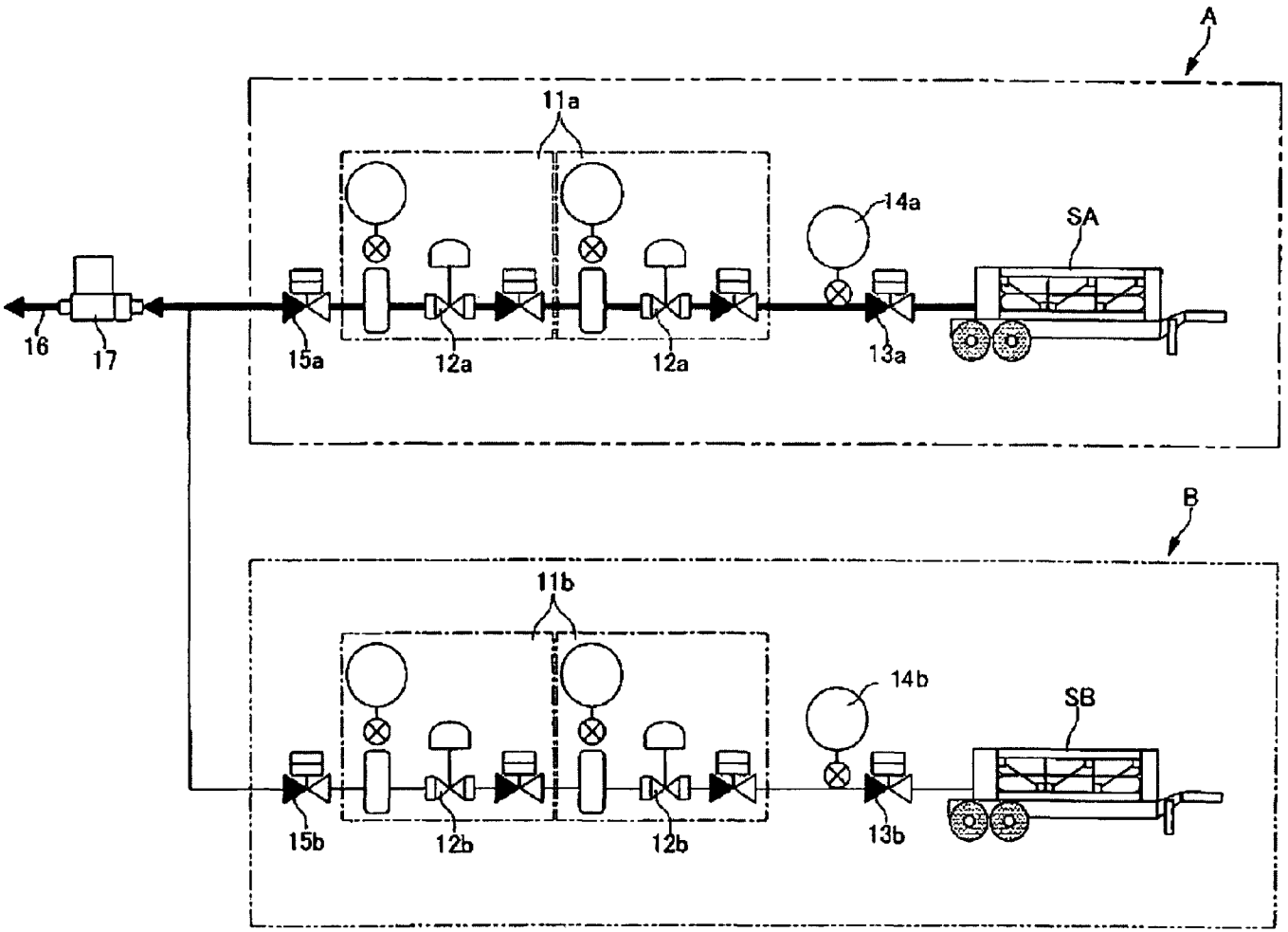
FIG. 1 is an illustrative drawing which shows one example of the gas supply equipment in which the gas supply method according to the present invention can be applied.
Figure 2:
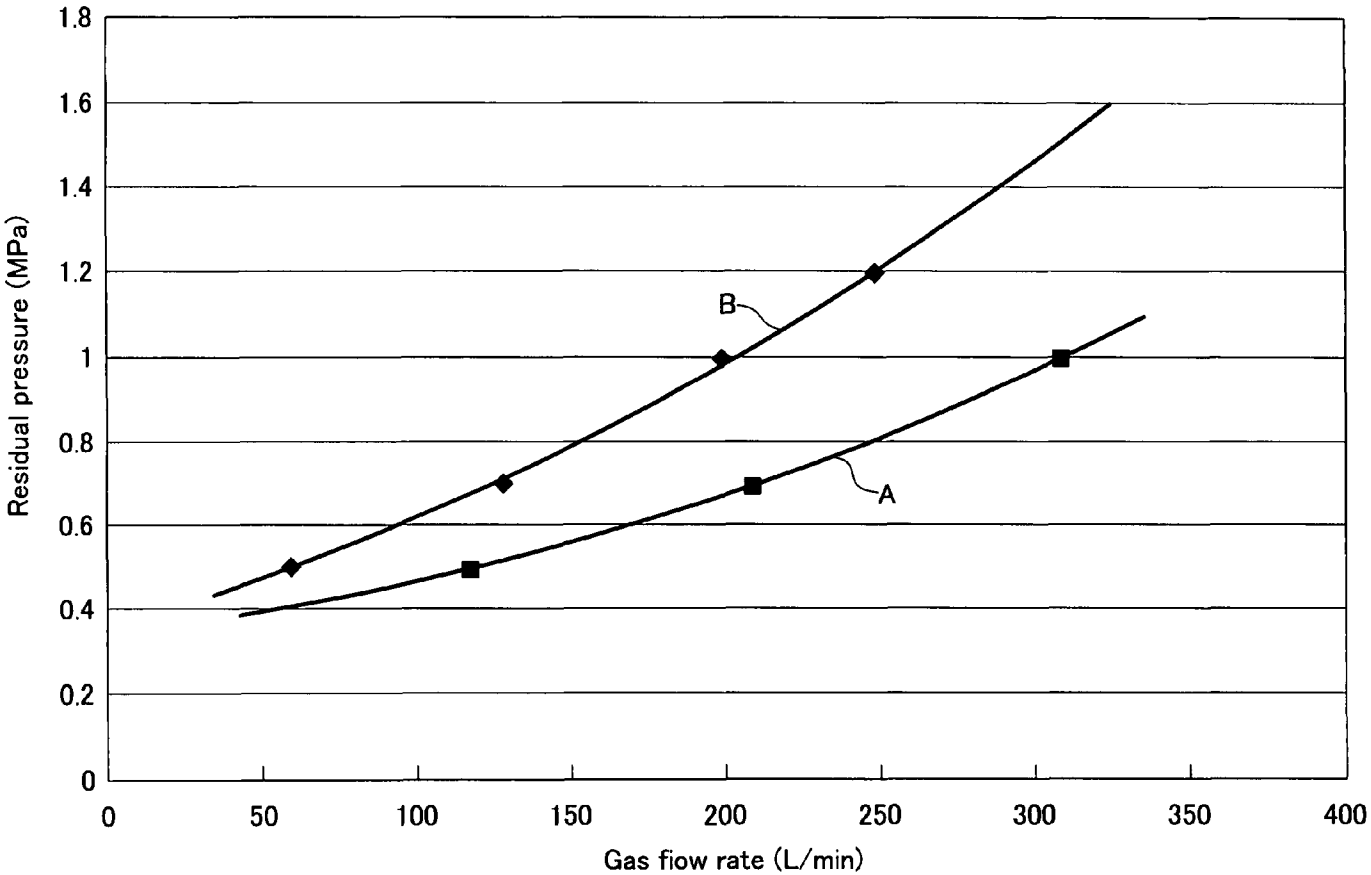
FIG. 2 shows the relationship between the residual pressures in the gas containers and the suppliable gas flow rate.
Figure 3:
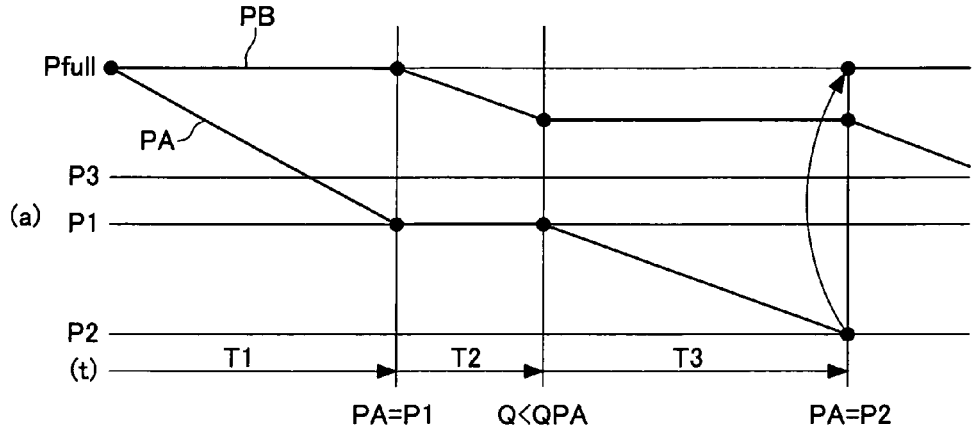
FIG. 3 shows the changes in the residual pressures in the gas containers to explain the first embodiment of the gas supply method according to the present invention.
Figure 3:
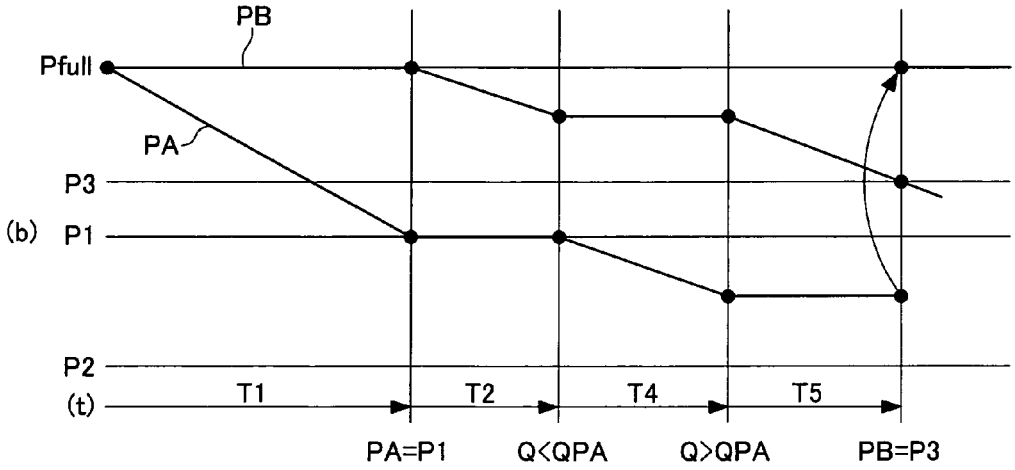

FIG. 1 is an illustrative drawing which shows one example of the gas supply equipment in which the gas supply method according to the present invention can be applied and FIG. 2 shows the relationship between the residual pressures in the gas containers and the suppliable gas flow rate. FIG. 3 shows the changes in the residual pressures in the gas containers to explain the first embodiment of the gas supply method according to the present invention.

First, as shown in FIG. 1, the gas supply equipment has two gas supply systems A, B which flow together at the downstream and are connected to a place where the gas is used. The systems A, B are each provided with a pressure-adjusting part 11*a*, 11*b* for reducing the pressure of the gas supplied from gas containers SA, SB, which are loaded with a compressed gas in a prescribed high-pressure condition, to a preset pressure. The pressure-adjusting parts 11*a*, 11*b* are each provided with plural pressure adjustors 12*a*, 12*b* that are connected in series.

In the upstream of each of the pressure-adjusting parts 11*a*, 11*b*, between them and the gas containers SA, SB, a high-pressure valve 13*a*, 13*b* and a pressure gauge 14*a*, 14*b* for detecting the pressure (residual pressure) within the gas containers SA, SB are provided. In the downstream of each of the pressure-adjusting parts 11*a*, 11*b*, a low-pressure valve 15*a*, 15*b* is provided. Further, a gas supply path 16 where the two systems A, B flow together is provided with a flowmeter 17 and a pressure gauge (not shown) are provided.

When the method according to the present invention is carried out using a gas supply equipment configured in this manner, first, as various preset values, a first preset flow rate Q1 and a second preset flow rate Q2, which are the maximum and minimum flow rates set in advance at the place where the gas is used, respectively; a first preset pressure P1 at which the residual pressure within the gas containers SA, SB capable of supplying the gas at a flow rate corresponding to the aforementioned first preset flow rate Q1 was set; in the same manner, a second preset pressure P2 at which the residual pressure within the gas containers SA, SB capable of supplying the gas at a flow rate corresponding to the aforementioned second preset flow rate Q2 was set; and a third preset pressure P3 set higher than the aforementioned first preset pressure P1 and lower than a gas loading pressure Pfull are set. Usually, the first preset pressure P1 may be set at the same pressure as a pressure at which the gas container is replaced (the lower limit of the residual pressure) in a conventional gas supply equipment.

The first preset flow rate Q1 and the second preset flow rate Q2 are set in accordance with the fluctuations in the gas usage flow rate at the place where the gas is used and satisfy the relationship of Q1>Q2. For example, in the case where the gas is a source gas for a semiconductor thin film-producing apparatus, the maximum flow rate is attained when a semiconductor thin film is being produced on a substrate by the semiconductor thin film-producing apparatus and the minimum flow rate is attained when a semiconductor thin film is not being produced, for example, at the time of replacing the substrate. Further, in cases where a number of semiconductor thin film-producing apparatuses are provided, fluctuations in the flow rate occur depending on the number of the apparatuses producing semiconductor thin film. Moreover, since the gas usage flow rate fluctuates depending on the apparatus operation time, such as whether the apparatus is operated during the day or night or on a business day or non-business day, as well as on other various conditions, the first preset flow rate Q1 and the second preset flow rate Q2 are set taking such conditions into consideration. In such cases where the minimum flow rate of the gas at the place of use thereof becomes extremely low (including a flow rate of 0) only for a short period of time, it is desired that the second preset flow rate Q2 be not set at such an extremely minimum flow rate, but rather be set at a minimum flow rate which is sustained continuously, for example, for not less than a several ten minutes.

The first preset pressure P1 and the second preset pressure P2 are automatically determined once the aforementioned first preset flow rate Q1 and second preset flow rate Q2, the type of the gas to be supplied and the constitution of the gas supply system are determined. For example, as shown in FIG. 2, even when the gas supply systems have an identical constitution, the suppliable flow rate when the residual pressure is 1.0 MPa is about 310 L/min for gas A, while, for gas B, the suppliable gas flow rate is about 200 L/min even when the residual pressure is the same at 1.0 MPa. Accordingly, when the first preset flow rate Q1 is 200 L/min, the first preset pressure P1 of the gas A is set at 0.7 MPa and the first preset pressure P1 of the gas B is set at 1.0 MPa. In the same manner, the second preset pressure P2 is also set at an appropriate pressure depending on whether it is the gas A or gas B.

Further, the aforementioned third preset pressure P3 is set in accordance with conditions such as the volume of the gas containers SA, SB, the amount of decrease in the gas within the gas containers SA, SB when the gas is supplied at the first preset flow rate Q1 and the time required for replacing the containers. For example, the P3 is set at a pressure at which the gas container SA can supply the gas at the first preset flow rate Q1 for 24 hours. The relationship of the preset pressures is, with respect to the gas loading pressure Pfull of the gas container SA, SB: Pfull>P3>P1>P2.

Further, as variables required for control, the residual pressures PA, PB in each gas containers SA, SB detected by the aforementioned pressure gauges 14*a*, 14*b*; the supplied gas flow rate Q detected by the aforementioned flowmeter 17; and the gas flow rates which can be supplied (suppliable gas flow rates: QPA, QPB) at the respective residual pressures PA, PB in each container are used. The residual pressures PA, PB in the containers are monitored at all times by the pressure gauges 14*a*, 14*b* and the supplied gas flow rate Q is monitored at all times by the flowmeter 17. In addition, as required, the pressure of the gas during the supply thereof is also monitored.

The first embodiment of the gas supply method will now be explained based on FIG. 3. It is noted here that, in the following explanations and figures, the expressions ">" and "<" also include those cases in which the numbers being compared are "equal".

First, in a normal use condition, during a period in which the gas is supplied from one of the gas containers SA, SB, for example, the first gas container SA, the other second gas container SB has already been replaced with a new gas container and the residual pressure (PB) therein is at the gas loading pressure Pfull. The residual pressures PA, PB in the gas containers SA, SB are both higher than the aforementioned first preset pressure P1 and in a condition capable of supplying the gas at a flow rate corresponding to the aforementioned first preset flow rate Q1. The supplied gas flow rate Q at this time is an arbitrary flow rate. It is described to be an arbitrary flow rate because the supplied gas flow rate Q naturally fluctuates with fluctuations in the gas usage flow rate at the place where the gas is used.

As shown in FIGS. 3(*a*) and 3(*b*), during the time T1, since the gas is supplied from the first gas container SA at a flow rate corresponding to the arbitrary supplied gas flow rate Q, the residual pressure PA in the first gas container SA decreases gradually with time t depending on the arbitrary supplied gas flow rate Q. Once the time T1 passed and the residual pressure PA in the first gas container SA decreased to the first preset pressure P1 (PA=P1) due to the gas supply, the gas container for supplying the gas to the place of use thereof is switched from the first gas container SA to the other second gas container SB.

After the switching of the gas container, the gas is supplied to the place of use thereof from the second gas container SB. However, when the time T2 passed and the arbitrary supplied gas flow rate Q, which is monitored at all times by the flowmeter 17, became a gas flow rate which can be supplied from the first gas container SA, that is, when the gas flow rate QPA, which can be supplied at the residual pressure PA in the first gas container SA, the residual pressure PA being in the range of less than the first preset pressure P1 and not less than the second preset pressure P2, is not less than the arbitrary supplied gas flow rate Q (Q<QPA), the gas container for supplying the gas to the place of use thereof is switched from the second gas container SB having a high residual pressure PB to the first gas container SA having a low residual pressure PA.

The suppliable gas flow rate QPA at the residual pressure PA is constantly updated by detecting the residual pressure PA which decreases with time depending on the arbitrary supplied gas flow rate Q. As long as the newly calculated suppliable gas flow rate QPA at the residual pressure PA is not less than the arbitrary supplied gas flow rate Q, the gas continues to be supplied from the first gas container SA. In this period, by opening the low-pressure valve 15*a* and closing the low-pressure valve 15*b*, the residual pressure PB in the second gas container SB is maintained at the residual pressure at the time of switching the gas container.

Then, as shown in FIG. 3(*a*), when the time T3 passed and the residual pressure PA in the first gas container SA decreased to the second preset pressure P2 (PA=P2), that is, when the first gas container SA became not able to provide the arbitrary supplied gas flow rate Q even at the second preset flow rate Q2, which is the minimum flow rate (Q (=Q2) >QPA), the gas container for supplying the gas is switched from the first gas container SA to the second gas container SB and an alarm goes off to prompt replacement of the first gas container SA, so that the first gas container SA is replaced with a new gas container. Accordingly, the residual pressure in the first gas container SA after the container replacement becomes Pfull to be on standby, and the residual pressure PB in the second gas container SB starts to decrease gradually with supplying of the gas. The replacement of the first gas container SA with a new gas container may be performed at any point during the period in which the gas can be supplied by the second gas container SB.

Further, as shown in FIG. 3(*b*), after the times T1 and T2 passed, when the time T4 further passed and the arbitrary supplied gas flow rate Q increased to not less than the gas flow rate QPA which can be supplied at the residual pressure PA in the first gas container SA (Q>QPA), since the residual pressure PB of the second gas container SB is higher than the residual pressure PA of the first gas container SA, the gas container for supplying the gas is switched from the first gas container SA to the second gas container SB. The switching of the gas container for supplying the gas is performed repeatedly based on the relationship between the suppliable gas flow rate QPA, which can be supplied at the residual pressure PA in the first gas container SA, and the arbitrary supplied gas flow rate Q. During a time period in which the arbitrary supplied gas flow rate Q is small, the gas is supplied preferentially from the first gas container SA whose the residual pressure PA is lower than the residual pressure PB.

Meanwhile, during the period in which the gas is supplied from the second gas container SB whose the residual pressure PB is higher than the residual pressure PA, when the time T5 passed and the residual pressure PB in the second gas container SB decreased to the third preset pressure P3 (PB=P3), an alarm goes off to prompt replacement of the first gas container SA, so that the first gas container SA is replaced with a new gas container and the residual pressure in the first gas container SA after the container replacement becomes Pfull. In this manner, in cases where the residual pressure PA in the first gas container SA, which is lower than the residual pressure PB, is not higher than the first preset pressure P1, by replacing the first gas container SA having a lower residual pressure before the residual pressure PB in the second gas container SB, which is higher than the residual pressure PA, decreases to the first preset pressure P1 (P1<PB<P3), it can be avoided that both of the residual pressures PA, PB in the gas containers SA, SB become less than the first preset pressure P1, that is, that the gas becomes not able to be supplied at a flow rate corresponding to the first preset flow rate Q1.

After the replacement of the first gas container SA, the gas continues to be supplied from the second gas container SB. This is the same condition in the above-described time T1 except that the first gas container SA is switched to the second gas container SB, and the switching of the gas container for supplying the gas is performed in the same condition as described in the above. During a time period in which the arbitrary supplied gas flow rate Q, that is, the gas usage flow rate at the place of use is low, by supplying the gas from the gas container having a low residual pressure, as long as the time (T3) in which the arbitrary supplied gas flow rate Q is low and the gas is supplied from the gas container having a low residual pressure is long, the residual pressure of the gas container can be reduced to the second preset pressure P2, which is the minimum pressure required for supplying the gas. Consequently, the amount of the gas remaining in the gas container at the time of replacement thereof can be reduced, so that the compressed gas loaded in the gas container can be effectively utilized.

For example, in cases where the residual pressure (the first preset pressure P1) required for supplying the gas at the first preset flow rate Q1, which is the maximum flow rate at the place where the gas is used, is 1 MPa and the residual pressure (the second preset pressure P2) required for supplying the gas at the second preset flow rate Q2, which is the minimum flow rate at the place where the gas is used, is 0.5 MPa, if the gas was supplied, as shown in FIG. 3(*a*), until the residual pressure in the gas container became 0.5 MPa, the amount of unused gas remaining in the gas container can be reduced to about half as compared to a conventional method.

Figure 4:
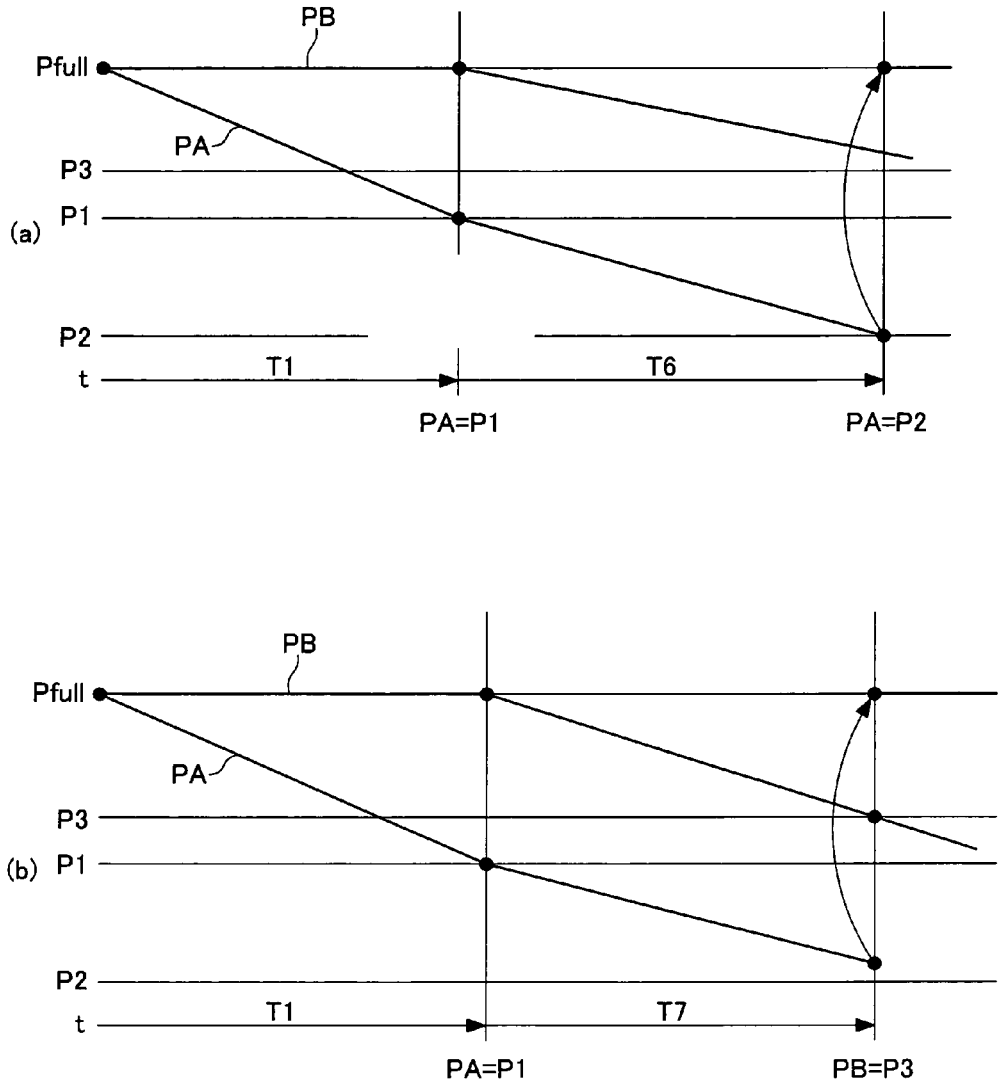
FIG. 4 shows the changes in the residual pressures in the gas containers to explain the second embodiment of the gas supply method according to the present invention.

FIG. 4 shows the changes in the residual pressures in the gas containers to explain the second embodiment of the gas supply method according to the present invention. It is noted here that, in the following explanations, the constitution shown in FIG. 1 may be employed for the gas supply equipment. Also, as various preset values, the first preset flow rate Q1, the second preset flow rate Q2, the first preset pressure P1, the second preset pressure P2 and the third preset pressure P3 are set in the same manner as described in the above, and both of the residual pressures PA, PB of the gas containers SA, SB are detected as variables.

In cases where the residual pressures PA, PB of the gas containers SA, SB are both higher than the first preset pressure P1 and the gas is supplied from the first gas container SA, once the time T1 passed and the residual pressure PA in the first gas container SA decreased to the first preset pressure P1 (PA=P1), since the gas starts to be supplied from the second gas container SB, a condition in which the gas is supplied to the place of use thereof simultaneously from both of the gas containers SA, SB is attained. Accordingly, the residual pressures PA, PB in both of the gas containers SA, SB start to decrease gradually with time t. In this case, the gas usage flow rate at the place where the gas is used is the sum of the supply flow rates from the first gas container SA and the second gas container SB.

As shown in FIG. 4(*a*), when the time T6 passed and the residual pressure PA in the first gas container SA decreased to the second preset pressure P2 (PA=P2), so that the first gas container SA became not able to supply the gas even at the arbitrary gas flow rate Q2, which is the minimum gas flow rate, supply of the gas from the first gas container SA is stopped and it is switched to be only from the second gas container SB. At the same time, the first gas container SA is replaced and the thus replaced first gas container SA is put on standby in the same manner as in the case of the second gas container SB in the time T1.

Further, as shown in FIG. 4(*b*), during the period in which the gas is supplied from both of the gas containers SA, SB, when the time T7 passed and the residual pressure PB in the second gas container SB having a high residual pressure decreased to the third preset pressure P3 (PB=P3), supply of the gas from the first gas container SA is stopped and while continuing the gas supply from the second gas container SB, the first gas container SA is replaced and the thus replaced first gas container SA is put on standby.

In this embodiment, when the residual pressure of one of the gas containers decreased to a pressure at which the maximum flow rate can no longer be ensured, the gas is supplied from both of the gas containers SA, SB. Consequently, the gas can be supplied to the place of thereof from the gas container having a low residual pressure in accordance with the fluctuations in the supplied gas flow rate Q, so that the compressed gas in the gas container can be effectively utilized.

Figure 5:
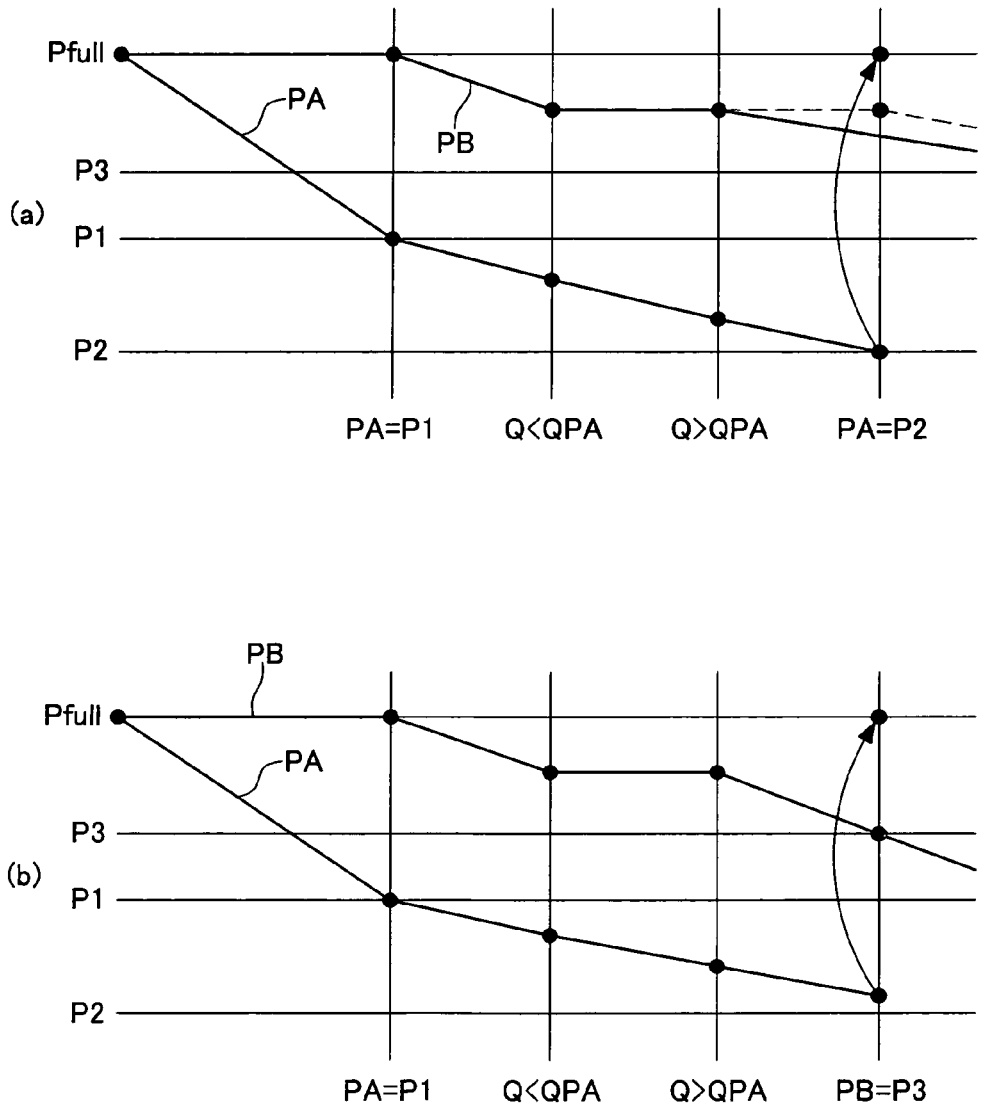
FIG. 5 shows the changes in the residual pressures in the gas containers to explain the third embodiment of the gas supply method according to the present invention.

FIG. 5 shows the changes in the residual pressures in the gas containers to explain the third embodiment of the gas supply method according to the present invention. In this embodiment too, as various preset values, the first preset flow rate Q1, the second preset flow rate Q2, the first preset pressure P1, the second preset pressure P2 and the third preset pressure P3 are set in the same manner as described in the above, and the arbitrary supplied gas flow rate Q (the gas usage flow rate at the place where the gas is used) and both of the residual pressures PA, PB of the gas containers SA, SB are detected as variables.

In cases where the residual pressures PA, PB of the gas containers SA, SB are both higher than the first preset pressure P1 and the gas is supplied from the first gas container SA, when the residual pressure PA in the first gas container SA decreased to the first preset pressure P1 (PA=P1), since the gas starts to be supplied from the second gas container SB, a condition in which the gas is supplied to the place of use thereof simultaneously from both of the gas containers SA, SB is attained. Accordingly, the residual pressures PA, PB in both of the gas containers SA, SB start to decrease gradually with time. In this case, the gas usage flow rate at the place where the gas is used is the sum of the supply flow rates from the first gas container and the second gas container.

During the period in which the gas is supplied from both of the gas containers SA, SB, when the arbitrary supplied gas flow rate Q is detected and the suppliable gas flow rate QPA, which can be supplied at the residual pressure PA in the gas container SA having a lower residual pressure at the time of the detection, is not less than the arbitrary supplied gas flow rate Q (Q<QPA), supply of the gas from the second gas container SB having a higher residual pressure is stopped and the gas is supplied only from the first gas container SA having a lower residual pressure PA.

The suppliable gas flow rate QPA, which can be supplied from the first gas container SA, is constantly calculated and updated in accordance with the residual pressure PA which decreases with supplying of the gas. As long as the thus updated suppliable gas flow rate QPA is not less than the arbitrary supplied gas flow rate Q, the gas continues to be supplied only from the first gas container SA. However, when the suppliable gas flow rate QPA became less than the arbitrary supplied gas flow rate Q (Q>QPA), supply of the gas from the second gas container SB is resumed, so that the gas becomes supplied from both of the gas containers SA, SB.

Further, as shown in FIG. 5(*a*), during the period in which the gas is supplied from both of the gas containers SA, SB or from the first gas container SA alone, when the residual pressure PA in the first gas container SA decreased to the second preset pressure P2 (PA=P2), supply of the gas from the first gas container SA is stopped and it is switched to be only from the second gas container SB, and at the same time, the first gas container SA is replaced and the thus replaced first gas container SA is put on standby.

In addition, as shown in FIG. 5(*b*), during the period in which the gas is supplied from both of the gas containers SA, SB, when the residual pressure PB in the second gas container SB decreased to the third preset pressure P3 (PB=P3), supply of the gas from the first gas container SA is stopped and while continuing the gas supply from the second gas container SB, the first gas container SA is replaced and the thus replaced first gas container SA is put on standby.

Figure 6:
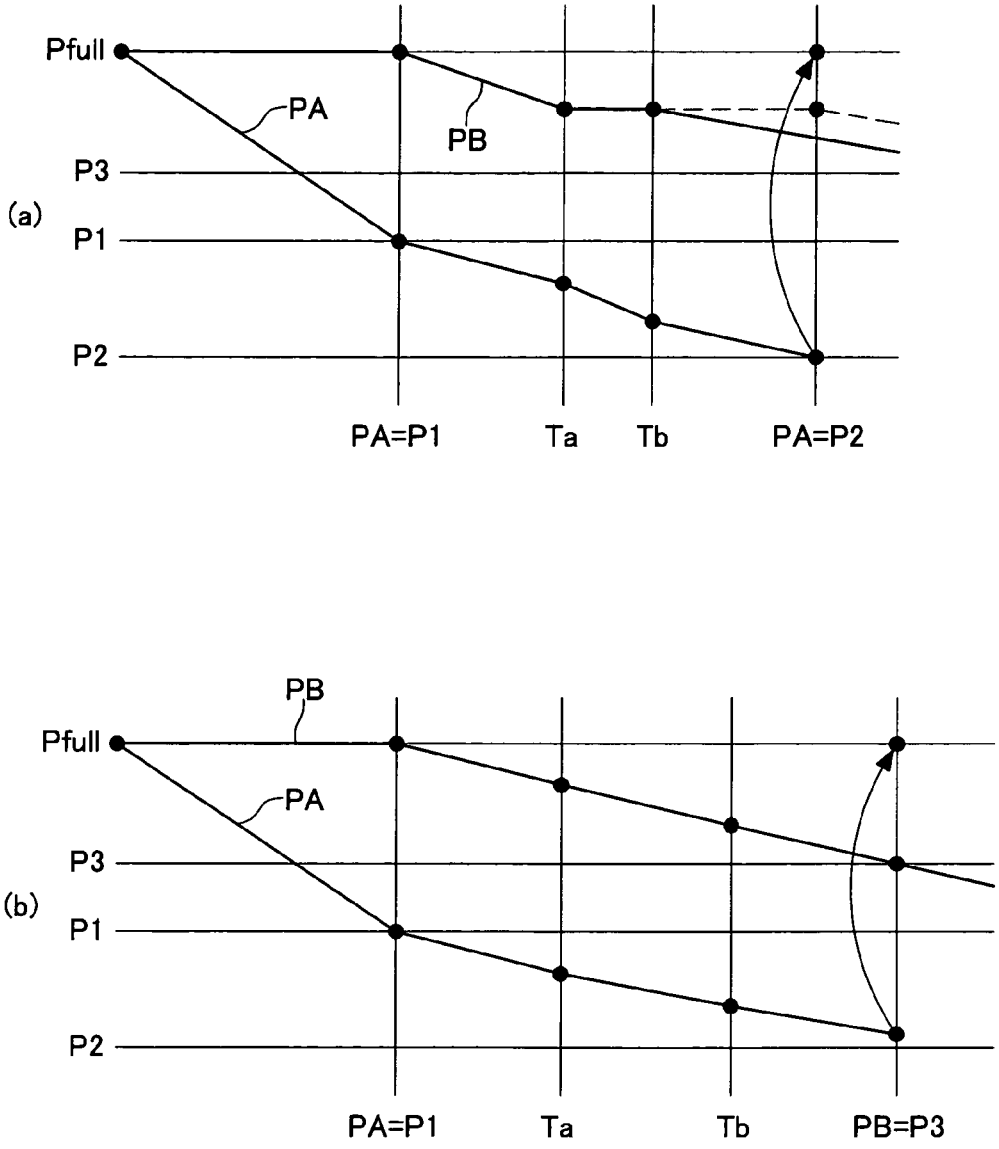
FIG. 6 shows the changes in the residual pressures in the gas containers to explain the fourth embodiment of the gas supply method according to the present invention.

FIG. 6 shows the changes in the residual pressures in the gas containers to explain the fourth embodiment of the gas supply method according to the present invention. In this embodiment too, as various preset values, the first preset flow rate Q1, the second preset flow rate Q2, the first preset pressure P1, the second preset pressure P2 and the third preset pressure P3 are set in the same manner as described in the above, and the arbitrary supplied gas flow rate Q (the gas usage flow rate at the place where the gas is used) and both of the residual pressures PA, PB of the gas containers SA, SB are detected as variables.

In cases where the residual pressures PA, PB of the gas containers SA, SB are both higher than the first preset pressure P1 and the gas is supplied from the first gas container SA, when the residual pressure PA in the first gas container SA decreased to the first preset pressure P1 (PA=P1), since the gas starts to be supplied from the second gas container SB, a condition in which the gas is supplied to the place of use thereof simultaneously from both of the gas containers SA, SB is attained. Accordingly, the residual pressures PA, PB in both of the gas containers SA, SB start to decrease gradually with time. In this case, the gas usage flow rate at the place where the gas is used is the sum of the supply flow rates from the first gas container and the second gas container.

At an arbitrary time during the period in which the gas is supplied from both of the gas containers SA, SB, supply of the gas from the gas container having a high residual pressure (in this case, the second gas container SB, since the residual pressure PB is higher than the residual pressure PA) is temporarily suspended and the gas is supplied only from the first gas container SA (the time Ta in FIG. 6). When the detected arbitrary supplied gas flow rate Q does not fluctuate (when the gas usage flow rate at the place where the gas is used does not change), that is, as long as the first gas container SA alone can sustain the gas supply at the arbitrary supplied gas flow rate Q, as shown in FIG. 6(*a*), the gas continues to be supplied only from the first gas container SA. Then, during the period in which the gas is supplied only from the gas first container SA, when the detected arbitrary supplied gas flow rate Q fluctuated (when the gas usage flow rate at the place where the gas used changed) (for example, at the time Tb in FIG. 6), that is, when the first gas container SA alone can no longer sufficiently sustain the gas supply at the arbitrary supplied gas flow rate Q, the gas supply from the second gas container SB is resumed, so that the gas becomes supplied from both of the gas containers SA, SB.

Meanwhile, when the gas supply from the second gas container SB was suspended (the time Ta in FIG. 6) and the detected arbitrary supplied gas flow rate Q fluctuated (when the gas usage flow rate at the place where the gas is used changed), as shown in FIG. 6(*b*), the gas supply from the second gas container SB is immediately resumed, so that the gas becomes supplied from both of the gas containers SA, SB. The temporary suspension of the gas supply from the second gas container SB having a high residual pressure PB is carried out at prescribed time intervals or when the supplied gas flow rate Q does not fluctuate within a preset time period (time Tc), and the aforementioned operations are appropriately repeated in accordance with the fluctuations in the arbitrary supplied gas flow rate Q (the gas usage flow rate at the place where the gas is used).

Further, as shown in FIG. 6(*a*), during the period in which the gas is supplied from both of the gas containers SA, SB or from the first gas container SA alone, when the residual pressure PA in the first gas container SA decreased to the second preset pressure P2 (PA=P2), supply of the gas from the first gas container SA is stopped and it is switched to be only from the second gas container SB, and at the same time, the first gas container SA is replaced and the thus replaced first gas container SA is put on standby.

In addition, as shown in FIG. 6(*b*), during the period in which the gas is supplied from both of the gas containers SA, SB, when the residual pressure PB in the second gas container SB decreased to the third preset pressure P3 (PB=P3), supply of the gas from the first gas container SA is stopped and while continuing the gas supply from the second gas container SB, the first gas container SA is replaced and the thus replaced first gas container SA is put on standby.

Figure 7:
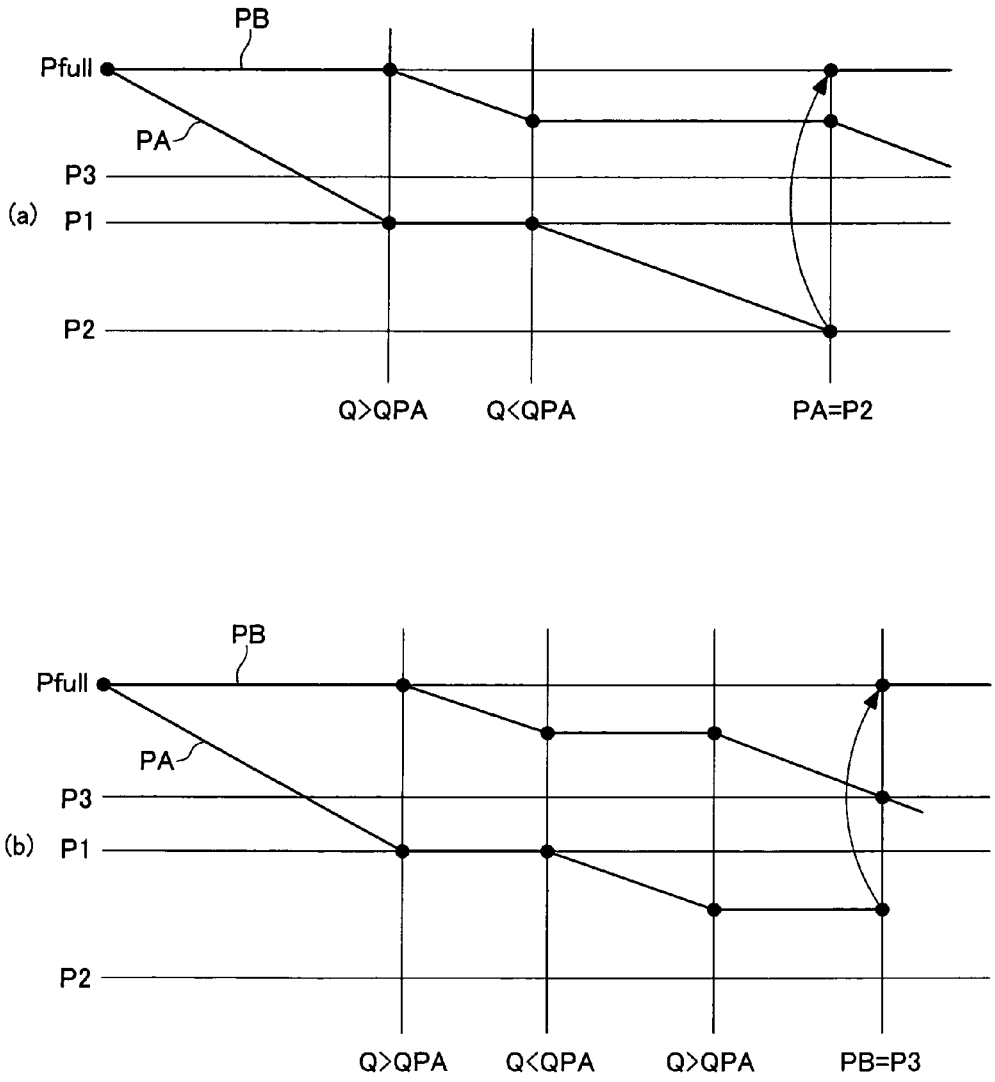
FIG. 7 shows the changes in the residual pressures in the gas containers to explain the fifth embodiment of the gas supply method according to the present invention.

FIG. 7 shows the changes in the residual pressures in the gas containers to explain the fifth embodiment of the gas supply method according to the present invention. In this embodiment too, as various preset values, the first preset flow rate Q1, the second preset flow rate Q2, the first preset pressure P1, the second preset pressure P2 and the third preset pressure P3 are set in the same manner as described in the above, and the arbitrary supplied gas flow rate Q (the gas usage flow rate at the place where the gas is used) and both of the residual pressures PA, PB of the gas containers SA, SB are detected as variables.

First, in a normal use condition, during a period in which the gas is supplied from one of the gas containers SA, SB, for example, from the first gas container SA, the other second gas container SB has already been replaced with a new gas container and the residual pressure (PB) is at the gas loading pressure Pfull. The residual pressures PA, PB in the gas containers SA, SB are both higher than the aforementioned first preset pressure P1 and in a condition capable of supplying the gas at a flow rate corresponding to the aforementioned first preset flow rate Q1.

The suppliable gas flow rates QPA, QPB, which can be supplied by the gas containers SA, SB, are each calculated from the residual pressures PA, PB in the gas containers SA, SB. The thus calculated suppliable gas flow rates QPA, QPB are each compared with the supplied gas flow rate Q at the time of the calculation. Here, in cases where the residual pressures PA, PB in the gas containers SA, SB are both not less than the first preset pressure P1, since the suppliable gas flow rates QPA, QPB, which can be supplied from the gas containers SA, SB, are both not less than the arbitrary supplied gas flow rate Q, the residual pressures PA, PB in the gas containers SA, SB are compared and the gas is supplied from the gas container having a lower residual pressure, for example, from the first gas container SA when the residual pressure PA is lower than the residual pressure PB. In cases where the residual pressures PA, PB are the same, they are assigned with an order of priority in advance and the gas container for supplying the gas may be selected in accordance with the order of priority.

During the period in which the gas is supplied from the first gas container SA, the suppliable gas flow rate QPA from the first gas container SA, which successively changes, is constantly compared with the arbitrary supplied gas flow rate Q. As long as the suppliable gas flow rate QPA calculated from the residual pressure PA is not less than the detected arbitrary supplied gas flow rate Q (Q<QPA), the gas continues to be supplied from the first gas container SA. When the suppliable gas flow rate QPA calculated from the residual pressure PA became less than the detected arbitrary supplied gas flow rate Q (Q>QPA), the gas supply from the first gas container SA is stopped and the gas starts to be supplied from the second gas container SB.

Also during the period in which the gas is supplied from the second gas container SB, the suppliable gas flow rate QPA, which can be supplied from the first gas container SA, is constantly compared with the arbitrary supplied gas flow rate Q. When the suppliable gas flow rate QPA became not less than the arbitrary supplied gas flow rate Q (Q<QPA), the gas supply from the second gas container SB having a high residual pressure PB is stopped and the gas supply from the first gas container SA having a low residual pressure PA is resumed. Hereinafter, the gas container for supplying the gas is switched in the same manner as described in the above in accordance with the relationship between the suppliable gas flow rate QPA, which can be supplied from the first gas container SA having a low the residual pressure, and the arbitrary supplied gas flow rate Q.

Further, as shown in FIG. 7(*a*), during the period in which the gas is supplied from the first gas container SA, when the residual pressure PA in the first gas container SA decreased to the second preset pressure P2 (PA=P2), supply of the gas from the first gas container SA is stopped and it is switched to be from the second gas container SB, and at the same time, the first gas container SA is replaced and the thus replaced first gas container SA is put on standby.

In addition, as shown in FIG. 7(*b*), during the period in which the gas is supplied from the second gas container SB, when the residual pressure PB in the second gas container SB decreased to the third preset pressure P3 (PB=P3), the first gas container SA is replaced while continuing the gas supply from the second gas container SB and the thus replaced first gas container SA is put on standby.

Figure 8:
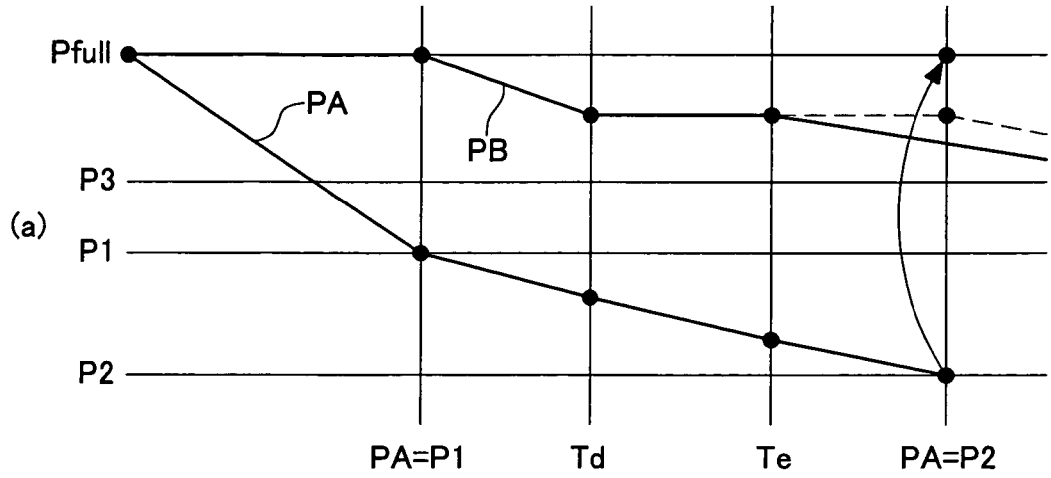
FIG. 8 shows the changes in the residual pressures in the gas containers to explain the sixth embodiment of the gas supply method according to the present invention.
Figure 8:
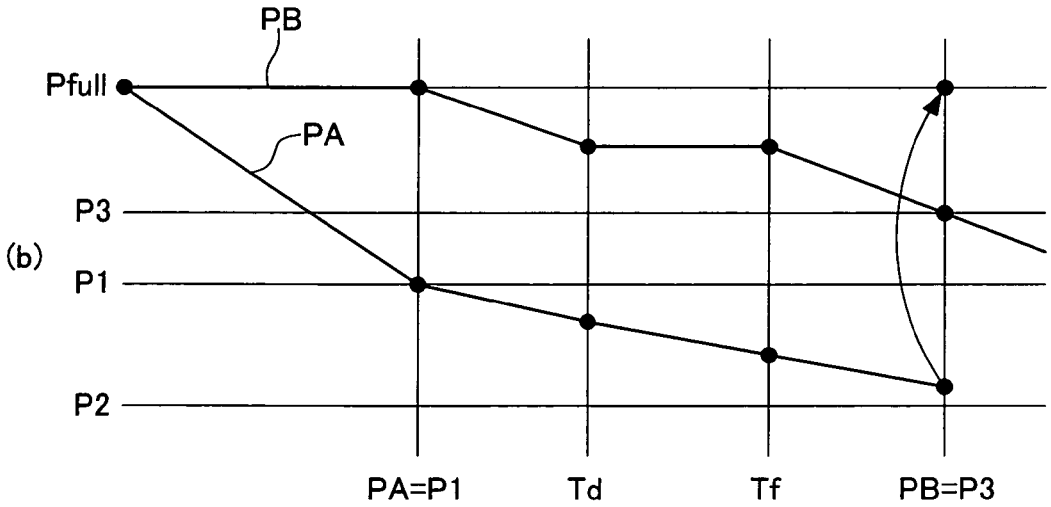

FIG. 8 shows the changes in the residual pressures in the gas containers to explain the sixth embodiment of the gas supply method according to the present invention. In this embodiment, as various preset values, the first preset flow rate Q1, the second preset flow rate Q2, the first preset pressure P1, the second preset pressure P2 and the third preset pressure P3 are set in the same manner as described in the above, and the preset supply pressure (PS), which is set in advance at the place where the gas is used, is also set. As variables, the pressure of the gas being supplied from the gas supply path 16 (detected supply pressure PT) and both of the residual pressures PA, PB in the gas containers SA, SB are detected.

In cases where the residual pressures PA, PB in the gas containers SA, SB are both not less than the first preset pressure P1 and the gas is supplied from the first gas container SA, when the residual pressure PA in the first gas container SA decreased to the first preset pressure P1 (PA=P1), since the gas starts to be supplied from the second gas container SB, a condition in which the gas is supplied to the place of use thereof simultaneously from both of the gas containers SA, SB is attained.

At an arbitrary time during the period in which the gas is supplied from both of the gas containers SA, SB, supply of the gas from the gas container having a high residual pressure (in this case, the second gas container SB, since the residual pressure PB is higher than the residual pressure PA) is temporarily suspended and the gas is supplied only from the first gas container SA (the time Td in FIG. 8). When the detected supply pressure PT does not decrease, that is, as long as the first gas container SA alone can sustain the pressure of the gas being supplied, the gas continues to be supplied only from the first gas container SA. Then, during the period in which the gas is supplied only from the gas first container SA, when the detected supply pressure PT decreased (for example, at the time Te in FIG. 8), the gas supply from the second gas container SB is resumed, so that the gas becomes supplied from both of the gas containers SA, SB.

Meanwhile, when the gas supply from the second gas container SB was suspended at the time Td and the detected supply pressure (PT) decreased, the gas supply from the second gas container SB is immediately resumed, so that the gas becomes supplied from both of the gas containers SA, SB. The temporary suspension of the gas supply from the second gas container SB having a high residual pressure PB is carried out at prescribed time intervals or when the detected supply pressure PT does not fluctuate within a preset time period (for example, the time Tf in FIG. 8(*b*)), and the aforementioned operations are appropriately repeated in accordance with the condition of the detected supply pressure PT.

Further, as shown in FIG. 8(*a*), during the period in which the gas is supplied from both of the gas containers SA, SB or from the first gas container SA alone, when the residual pressure PA in the first gas container SA decreased to the second preset pressure P2 (PA=P2), supply of the gas from the first gas container SA is stopped and it is switched to be from the second gas container SB, and at the same time, the first gas container SA is replaced and the thus replaced first gas container SA is put on standby.

In addition, as shown in FIG. 8(*b*), during the period in which the gas is supplied from both of the gas containers SA, SB, when the residual pressure PB in the second gas container SB decreased to the third preset pressure P3 (PB=P3), the gas supply from the first gas container is stopped and while continuing the gas supply from the second gas container SB, the first gas container SA is replaced and the thus replaced first gas container SA is put on standby.

As shown in the above embodiments, when the residual pressure in one of the gas containers decreased to the first preset pressure P1 at which the gas cannot be supplied at the first preset flow rate Q1, the container is replaced at this residual pressure in a conventional method; however, in the present invention, the gas is supplied from the other gas container having a high residual pressure and at the same time, supply of the gas from the gas container having a low residual pressure is performed in accordance with the changes in the supplied gas flow rate Q at which the gas is supplied to the place of use thereof. Thereby, the compressed gas in the gas containers can be supplied to the place of use until the residual pressure becomes lower as compared to a conventional method, so that the amount of unused gas remaining in the gas container at the time of replacement thereof can be greatly reduced.

In addition, when the residual pressure in a gas container decreased to a pressure at which the gas can no longer be supplied at the second preset flow rate Q2, the container is replaced, and during the period in which the residual pressure in one of the gas containers is lower than the first preset pressure P1, the gas container having a lower residual pressure is replaced when the residual pressure in the other gas container decreased to the third preset pressure P3. Thereby, the residual pressures in both of the gas containers never become lower than the first preset pressure P1, so that it can be ensured that the gas is supplied at the first preset flow rate Q1, which is the maximum flow rate.

It is noted here that the constitution of the gas supply equipment, as well as the form of the gas containers and the type of the gas to be supplied, are arbitrary. Further, the same operations are feasible also in a gas supply equipment having 3 or more gas supply systems, and it is also possible to connect plural gas containers to one gas supply system.

DESCRIPTION OF SYMBOLS

11*a*, 11*b*: pressure-adjusting part
12*a*, 12*b*: pressure adjustor
13*a*, 13*b*: high-pressure valve
14*a*, 14*b*: pressure gauge
15*a*, 15*b*: low-pressure valve
16: gas supply path
17: flowmeter
A, B: gas supply system
SA, SB: gas container

The invention claimed is:

1. A gas supply method by which a compressed gas loaded in gas containers, each of which is connected to one of a plurality of gas supply systems, is supplied to a place of use thereof where gas usage flow rate fluctuates, said method being characterized in that, by monitoring residual pressures (PA, PB) in said gas containers and a supplied gas flow rate (Q): during a period in which said residual pressures (PA, PB) of a first gas container (SA) and a second gas container (SB), respectively, are both not less than a first preset pressure (P1) and said gas is supplied to said place of use thereof from said first gas container (SA), when said residual pressure (PA) in said first gas container (SA) decreased to said first preset pressure (P1), supply of said gas to said place of use is switched from said first gas container (SA) to said second gas container (SB); during a period in which, after said switching, said gas is supplied to said place of use from said second gas container (SB), when said supplied gas flow rate (Q) became less than a gas flow rate (QPA) which can be supplied from said first gas container (SA) having said residual pressure (PA) in the range of less than said first preset pressure (P1) and not less than said second preset pressure (P2), supply of said gas to said place of use is switched from said second gas container (SB) to said first gas container (SA); during a period in which said gas is supplied to said place of use thereof from said first gas container (SA) whose said residual pressure (PA) is less than said first preset pressure (P1) and not less than said second preset pressure (P2), when said supplied gas flow rate (Q) became not less than said gas flow rate (QPA) suppliable from said first gas container (SA), supply of said gas to said place of use is switched from said first gas container (SA) to said second gas container (SB); during said period in which said gas is supplied to said place of use thereof from said first gas container (SA) whose said residual pressure (PA) is less than said first preset pressure (P1) and not less than said second preset pressure (P2), when said residual pressure (PA) in said first gas container (SA) decreased to said preset pressure (P2), supply of said gas to said place of use is switched from said first gas container (SA) to said second gas container (SB) and at the same time, said first gas container (SA) is replaced; and, during a period in which said residual pressure (PA) in said first gas container (SA) is less than said first preset pressure (P1) and said gas is supplied to said place of use thereof from said second gas container (SB) whose said residual pressure (PB) is not less than said first preset pressure (P1), when said residual pressure (PB) in said second gas container (SB) decreased to a third preset pressure (P3), said first gas container (SA) is replaced (wherein, said first preset pressure (P1) is a pressure at which said residual pressure in said gas container capable of supplying said gas at a flow rate corresponding to said first preset flow rate (Q1) was set;

said second preset pressure (P2) is a pressure at which said residual pressure in said gas container capable of supplying said gas at a flow rate corresponding to a second preset flow rate (Q2) was set;

said third preset pressure (P3) is a pressure set higher than said first preset pressure (P1) and lower than a gas loading pressure;

said residual pressures (PA, PB) are residual pressures obtained by detecting the pressures in said gas containers (SA, SB);

said supplied gas flow rate (Q) is a gas flow rate obtained by detecting the flow rate of said gas being supplied to said place of use thereof; and said gas flow rates (QPA, QPB) are gas flow rates suppliable at said residual pressures (PA, PB) in said gas containers;

with the proviso that:

a first preset flow rate (Q1) is a flow rate which was set in advance at said place of use of said gas; and said second preset flow rate (Q2) is a flow rate which was set in advance at said place of use of said gas and is lower than said first preset flow rate (Q1)).

2. The gas supply method according to claim 1, characterized in that the relationship between said residual pressures in said gas containers and said suppliable gas flow rates have been set in advance in accordance with the type of said gas to be supplied and constitution of said gas supply systems.

3. A gas supply method by which a compressed gas loaded in gas containers, each of which is connected to one of a plurality of gas supply systems, is supplied to a place of use thereof where gas usage flow rate fluctuates, said method being characterized in that, by monitoring residual pressures (PA, PB) in said gas containers: during a period in which said residual pressures (PA, PB) of a first gas container (SA) and a second gas container (SB), respectively, are both not less than a first preset pressure (P1) and said gas is supplied to said place of use thereof from said first gas container (SA), when said residual pressure (PA) in said first gas container (SA) decreased to said first preset pressure (P1), said gas starts to be supplied from said second gas container (SB), so that said gas is supplied to said place of use thereof from both of said first and second gas containers (SA, SB); and during a period in which said gas is supplied to said place of use thereof from said first and second gas containers (SA, SB), when said residual pressure (PA) in said first gas container (SA) having a lower residual pressure decreased to a second preset pressure (P2) or when said residual pressure (PB) in said second gas container (SB) having a higher residual pressure decreased to a third preset pressure (P3), said first gas container (SA) is replaced (wherein, said first preset pressure (P1) is a pressure at which said residual pressure in said gas container capable of supplying said gas at a flow rate corresponding to said first preset flow rate (Q1) was set;

said second preset pressure (P2) is a pressure at which said residual pressure in said gas container capable of supplying said gas at a flow rate corresponding to said second preset flow rate (Q2) was set;

said third preset pressure (P3) is a pressure set higher than said first preset pressure (P1) and lower than a gas loading pressure; and said residual pressures (PA, PB) are residual pressures obtained by detecting the pressures in said gas containers (SA, SB);

with the proviso that:

said first preset flow rate (Q1) is a flow rate which was set in advance at said place of use of said gas; and said second preset flow rate (Q2) is a flow rate which was set in advance at said place of use of said gas and is lower than said first preset flow rate (Q1)).

4. The gas supply method according to claim 3, characterized in that the relationship between said residual pressures in said gas containers and said suppliable gas flow rates have been set in advance in accordance with the type of said gas to be supplied and constitution of said gas supply systems.

5. A gas supply method by which a compressed gas loaded in gas containers, each of which is connected to one of a plurality of gas supply systems, is supplied to a place of use thereof where gas usage flow rate fluctuates, said method being characterized in that, by monitoring residual pressures (PA, PB) in said gas containers and a supplied gas flow rate (Q): during a period in which said residual pressures (PA, PB) of a first gas container (SA) and a second gas container (SB), respectively, are both not less than a first preset pressure (P1) and said gas is supplied to said place of use thereof from said first gas container (SA), when said residual pressure (PA) in said first gas container (SA) decreased to said first preset pressure (P1), said gas starts to be supplied from said second gas container (SB), so that said gas is supplied to said place of use thereof from both of said first and second gas containers (SA, SB); during a period in which said gas is supplied to said place of use thereof from said first and second gas containers (SA, SB), when said supplied gas flow rate (Q) became less than a gas flow rate (QPA) which can be supplied from said first gas container (SA) having said residual pressure (PA) in the range of less than said first preset pressure (P1) and not less than said second preset pressure (P2), supply of said gas from said second gas container (SB) is stopped and said gas is supplied to said place of use thereof from said first gas container (SA); and during a period in which said gas is supplied to said place of use thereof from said first gas container (SA) whose said residual pressure (PA) is less than said first preset pressure (P1) and not less than said second preset pressure (P2), when said supplied gas flow rate (Q) became not less than said gas flow rate (QPA) suppliable from said first gas container (SA), said gas starts to be supplied from said second gas container (SB), so that said gas is supplied to said place of use thereof from both of said first and second gas containers (SA, SB), and when said residual pressure (PA) in said first gas container (SA) having a lower residual pressure decreased to said second preset pressure (P2) or when said residual pressure (PB) in said second gas container (SB) having a higher residual pressure decreased to a third preset pressure (P3), said first gas container (SA) is replaced (wherein, said first preset pressure (P1) is a pressure at which said residual pressure in said gas container capable of supplying said gas at a flow rate corresponding to said first preset flow rate (Q1) was set;

said second preset pressure (P2) is a pressure at which said residual pressure in said gas container capable of supplying said gas at a flow rate corresponding to said second preset flow rate (Q2) was set;

said third preset pressure (P3) is a pressure set higher than said first preset pressure (P1) and lower than a gas loading pressure;

said residual pressures (PA, PB) are residual pressures obtained by detecting the pressures in said gas containers (SA, SB);

said supplied gas flow rate (Q) is a gas flow rate obtained by detecting the flow rate of said gas being supplied to said place of use thereof; and said gas flow rates (QPA, QPB) are gas flow rates suppliable at said residual pressures (PA, PB) in said gas containers;

with the proviso that:

said first preset flow rate (Q1) is a flow rate which was set in advance at said place of use of said gas; and said second preset flow rate (Q2) is a flow rate which was set in advance at said place of use of said gas and is lower than said first preset flow rate (Q1)).

6. The gas supply method according to claim 5, characterized in that the relationship between said residual pressures in said gas containers and said suppliable gas flow rates have been set in advance in accordance with the type of said gas to be supplied and constitution of said gas supply systems.

7. A gas supply method by which a compressed gas loaded in gas containers, each of which is connected to one of a plurality of gas supply systems, is supplied to a place of use thereof where gas usage flow rate fluctuates, said method being characterized in that, by monitoring residual pressures (PA, PB) in said gas containers and a supplied gas flow rate (Q): during a period in which said residual pressures (PA, PB) of a first gas container (SA) and a second gas container (SB), respectively, are both not less than a first preset pressure (P1) and said gas is supplied to said place of use thereof from said first gas container (SA), when said residual pressure (PA) in said first gas container (SA) decreased to said first preset pressure (P1), said gas starts to be supplied from said second gas container (SB), so that said gas is supplied to said place of use thereof from both of said first and second gas containers (SA, SB); and during a period in which said gas is supplied to said place of use thereof from said first and second gas containers (SA, SB), when supply of said gas from said second gas container (SB) having a higher residual pressure was suspended and said supplied gas flow rate (Q) does not fluctuate, said gas is supplied to said place of use thereof from said first gas container (SA) while suspending said supply of said gas from said second gas container (SB), and when said supply of said gas from said second gas container (SB) having a higher residual pressure was suspended and said supplied gas flow rate (Q) fluctuated, said supply of said gas from said second gas container (SB) is resumed, so that said gas is supplied to said place of use thereof from both of said first and second gas containers (SA, SB), and further, when said residual pressure (PA) in said first gas container (SA) having a lower residual pressure decreased to a second preset pressure (P2) or when said residual pressure (PB) in said second gas container (SB) having a higher residual pressure decreased to a third preset pressure (P3), said first gas container (SA) is replaced (wherein, said first preset pressure (P1) is a pressure at which said residual pressure in said gas container-capable of supplying said gas at a flow rate corresponding to said first preset flow rate (Q1) was set;

said second preset pressure (P2) is a pressure at which said residual pressure in said gas container capable of supplying said gas at a flow rate corresponding to said second preset flow rate (Q2) was set;

said third preset pressure (P3) is a pressure set higher than said first preset pressure (P1) and lower than a gas loading pressure;

said residual pressures (PA, PB) are residual pressures obtained by detecting the pressures in said gas containers (SA, SB);

said supplied gas flow rate (Q) is a gas flow rate obtained by detecting the flow rate of said gas being supplied to said place of use thereof; and said gas flow rates (QPA, QPB) are gas flow rates suppliable at said residual pressures (PA, PB) in said gas containers;

with the proviso that:

said first preset flow rate (Q1) is a flow rate which was set in advance at said place of use of said gas; and said second preset flow rate (Q2) is a flow rate which was set in advance at said place of use of said gas and is lower than said first preset flow rate (Q1)).

8. The gas supply method according to claim 7, characterized in that the relationship between said residual pressures in said gas containers and said suppliable gas flow rates have been set in advance in accordance with the type of said gas to be supplied and constitution of said gas supply systems.

9. A gas supply method by which a compressed gas loaded in gas containers, each of which is connected to one of a plurality of gas supply systems, is supplied to a place of use thereof where gas usage flow rate fluctuates, said method being characterized in that, by monitoring residual pressures (PA, PB) in said containers and a supplied gas flow rate (Q), in cases where said residual pressure (PA) in a first gas container (SA) is lower than said residual pressure (PB) in the other second gas container (SB): when said supplied gas flow rate (Q) is less than a gas flow rate (QPA) suppliable from said first gas container (SA) having a lower residual pressure, said gas is supplied to said place of use thereof from said first gas container (SA) having a lower residual pressure; when said supplied gas flow rate (Q) is not less than said gas flow rate (QPA) suppliable from said first gas container (SA) having a lower residual pressure, supply of said gas to said place of use is switched from said first gas container (SA) to said second gas container (SB) having a higher residual pressure or said gas starts to be supplied from said second gas container (SB), so that said gas is supplied to said place of use thereof from both of said first and second gas containers (SA, SB); when said residual pressure (PA) in said first gas container (SA) having a lower residual pressure decreased to a second preset pressure (P2) or when said residual pressure (PB) in said second gas container (SB) having a higher residual pressure decreased to a third preset pressure (P3), said first gas container (SA) is replaced (wherein, said first preset pressure (P1) is a pressure at which said residual pressure in said gas container capable of supplying said gas at a flow rate corresponding to said first preset flow rate (Q1) was set;

said second preset pressure (P2) is a pressure at which said residual pressure in said gas container capable of supplying said gas at a flow rate corresponding to said second preset flow rate (Q2) was set;

said third preset pressure (P3) is a pressure set higher than said first preset pressure (P1) and lower than a gas loading pressure;

said residual pressures (PA, PB) are residual pressures obtained by detecting the pressures in said gas containers (SA, SB);

said supplied gas flow rate (Q) is a gas flow rate obtained by detecting the flow rate of said gas being supplied to said place of use thereof; and said gas flow rates (QPA, QPB) are gas flow rates suppliable at said residual pressures (PA, PB) in said gas containers;

with the proviso that:

said first preset flow rate (Q1) is a flow rate which was set in advance at said place of use of said gas; and said second preset flow rate (Q2) is a flow rate which was set in advance at said place of use of said gas and is lower than said first preset flow rate (Q1)).

10. The gas supply method according to claim 9, characterized in that the relationship between said residual pressures in said gas containers and said suppliable gas flow rates have been set in advance in accordance with the type of said gas to be supplied and constitution of said gas supply systems.

11. A gas supply method by which a compressed gas loaded in gas containers, each of which is connected to one of a plurality of gas supply systems, is supplied to a place of use thereof where gas usage flow rate fluctuates, said method being characterized in that, by monitoring residual pressures (PA, PB) in said gas containers and a detected supply pressure (PT): during a period in which said residual pressures (PA, PB) of a first gas container (SA) and a second gas container (SB), respectively, are both not less than a first preset pressure (P1) and said gas is supplied to said place of use thereof from said first gas container (SA), when said residual pressure (PA) in said first gas container (SA) decreased to said first preset pressure (P1), said gas starts to be supplied from said second gas container (SB), so that said gas is supplied to said place of use thereof from both of said first and second gas containers (SA, SB); and during a period in which said gas is supplied to said place of use thereof from said first and second gas containers (SA, SB), when supply of said gas from said second gas container (SB) having a higher residual pressure was suspended and said detected supply pressure (PT) does not decrease, said gas is supplied to said place of use thereof from said first gas container (SA) while suspending said supply of said gas from said second gas container (SB), and when said supply of said gas from said second gas container (SB) having a higher residual pressure was suspended and said detected supply pressure (PT) decreased, said supply of said gas from said second gas container (SB) is resumed, so that said gas is supplied to said place of use thereof from both of said first and second gas containers (SA, SB), and further, when said residual pressure (PA) in said first gas container (SA) having a lower residual pressure decreased to a second preset pressure (P2) or when said residual pressure (PB) in said second gas container (SB) having a higher residual pressure decreased to a third preset pressure (P3), said first gas container (SA) is replaced (wherein, a preset supply pressure (PS) is a pressure set in advance at said place of use of said gas;

said first preset pressure (P1) is a pressure at which said residual pressure in said gas container capable of supplying said gas at a flow rate corresponding to said first preset flow rate (Q1) was set;

said second preset pressure (P2) is a pressure at which said residual pressure in said gas container capable of supplying said gas at a flow rate corresponding to said second preset flow rate (Q2) was set;

said third preset pressure (P3) is a pressure set higher than said first preset pressure (P1) and lower than a gas loading pressure;

said residual pressures (PA, PB) are residual pressures obtained by detecting the pressures in said gas containers (SA, SB); and said detected supply pressure (PT) is a pressure obtained by detecting the pressure being supplied to said place of use thereof;

with the proviso that:

said first preset flow rate (Q1) is a flow rate which was set in advance at said place of use of said gas; and said second preset flow rate (Q2) is a flow rate which was set in advance at said place of use of said gas and is lower than said first preset flow rate (Q1)).

12. The gas supply method according to claim 11, characterized in that the relationship between said residual pressures in said gas containers and said suppliable gas flow rates have been set in advance in accordance with the type of said gas to be supplied and constitution of said gas supply systems.

* * * * *